US005086936A

United States Patent [19]

Remmers

[11] Patent Number: 5,086,936

[45] Date of Patent: Feb. 11, 1992

[54] CABINET STACKING BASKET ORGANIZER

[75] Inventor: Lee Remmers, Ocala, Fla.

[73] Assignee: Clairson International, Fla.

[21] Appl. No.: 506,207

[22] Filed: Apr. 9, 1990

[51] Int. Cl.[5] ..... A47F 3/14

[52] U.S. Cl. ..... 211/126; 211/162

[58] Field of Search ..... 211/126, 128, 162, 151, 211/181, 175; 220/4.27

[56] References Cited

U.S. PATENT DOCUMENTS

| | | | |
|---|---|---|---|
| 167,549 | 9/1875 | Lowman et al. | 211/128 |
| 2,466,033 | 4/1949 | Martin | 211/126 X |
| 3,022,900 | 2/1962 | Averill | 211/126 |
| 3,125,225 | 3/1964 | Brengman et al. | 211/162 X |
| 3,199,683 | 8/1965 | Graswich | 211/126 X |

*Primary Examiner*—Blair M. Johnson
*Assistant Examiner*—Derek J. Berger
*Attorney, Agent, or Firm*—Cushman, Darby & Cushman

[57] ABSTRACT

A stacking basket organizer as provided which include at least two vertically interconnected support bases for slidably supporting first and second baskets. If the storage space to be occupied by the basket organizer is of sufficient height, one or more additional baskets and respective support bases can be provided. A cabinet slide is preferably provided on each lateral side of each support base for slidably engaging a corresponding rail provided on either lateral side of a respective basket. The rails can be coupled to the sides of the basket with a rail clamp adapted to clamp the rail against the rods defining the lateral sides of the basket.

4 Claims, 11 Drawing Sheets

CABINET STACKING BASKET ORGANIZER

BACKGROUND OF THE INVENTION

1. Field of the Invention

The present invention relates to cabinet organizers and, more particularly, to a stacking basket organizer for maximizing usable storage space within, for example, a cabinet.

2. Description of the Related Art

Numerous shelving assemblies have been developed to date for organizing closets and cabinets and, in particular, for increasing usable storage space. Typically, such organizers are in the form of shelves or stacked shelves which turn open space into a storage area. Such organizers are versatile in that the number of shelves provided and their particular configuration can be varied in accordance with the needs of the user.

While such stacking shelves significantly increase usable storage space, they exhibit a problem common to all shelving systems, that is limited access to objects disposed at the back of the shelf. It would therefore be desirable to provide an organizer which turns open space into useful storage space while enabling easy access to all items stored therewith.

SUMMARY OF THE INVENTION

It is an object of the present invention to provide an organizer for cabinets and closets which is easy to assemble and versatile so that the particular needs of an individual can be satisfied.

Thus it is an object of the invention to provide a stacking basket organizer which enables two or more baskets to be stacked atop one another to increase storage space while enabling as easy access to objects disposed at the rear of each basket as those disposed at the front of each basket, by slide mounting the baskets.

It is a further object of the invention to provide a stacking basket assembly which makes it possible for smaller sliding baskets to be mounted vertically above large sliding baskets.

It is an even further object of the invention to provide a stacking basket organizer wherein a smaller basket can be selectively disposed above a bigger basket at a predetermined location in the widthwise direction of the larger basket.

To achieve the foregoing objects, the invention provides a basket assembly which comprises a first base frame, a second base frame, means for mounting the second base frame to the first base frame so that the second base frame is disposed vertically above and spaced from the first base frame; a first basket member having a longitudinal axis; means for slidably mounting the first basket member to the first base frame; a second basket member having a longitudinal axis; and means for slidably mounting the second basket to said second base frame.

Other objects, characteristics and features of the present invention, as well as the methods of operation and functions of the related elements of the structure, will become more apparent upon consideration of the following detailed description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENT

Figure 1:
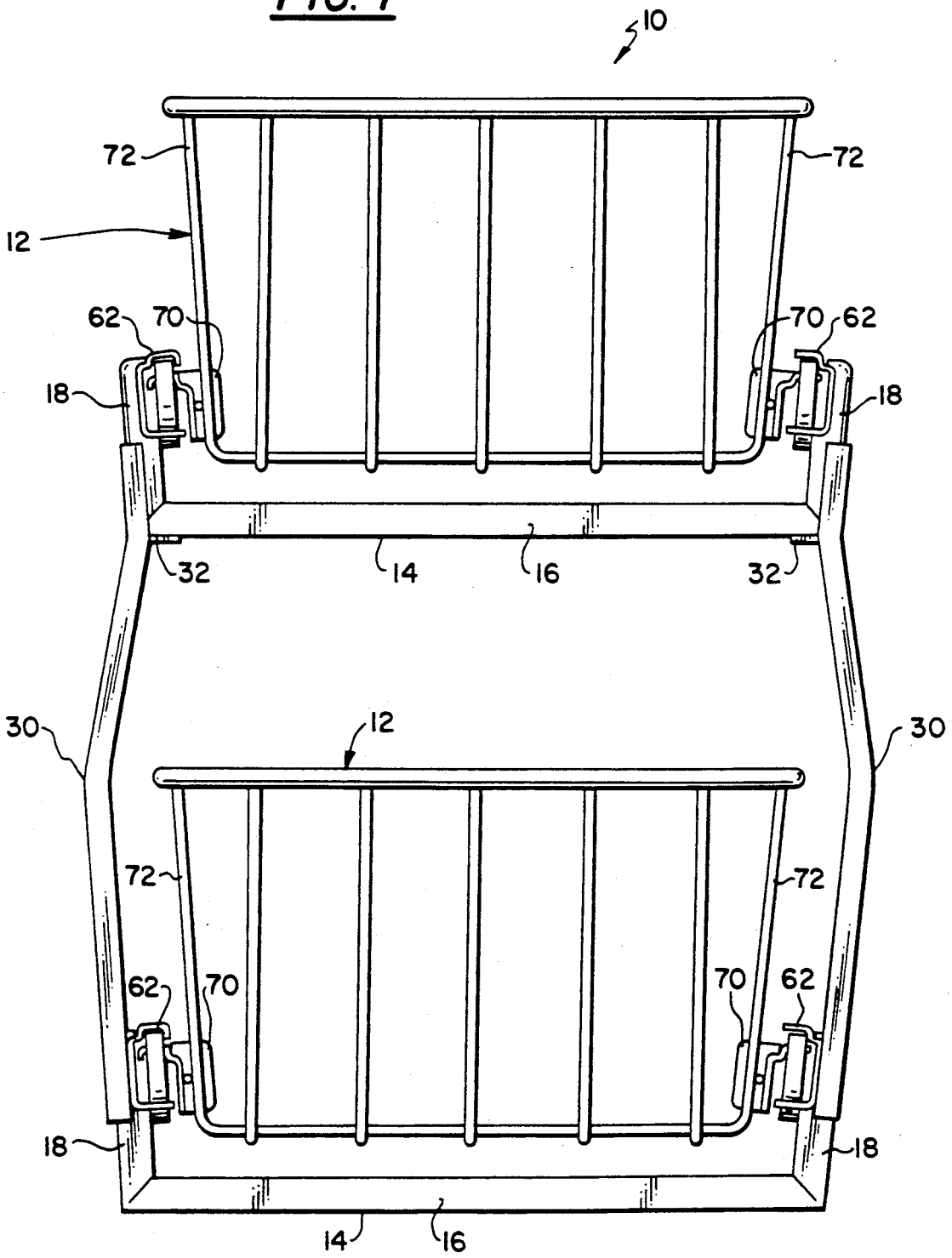
FIG. 1 is a schematic rear elevational view of a stacking basket organizer provided in accordance with the present invention with some parts omitted for clarity.
Figure 2:
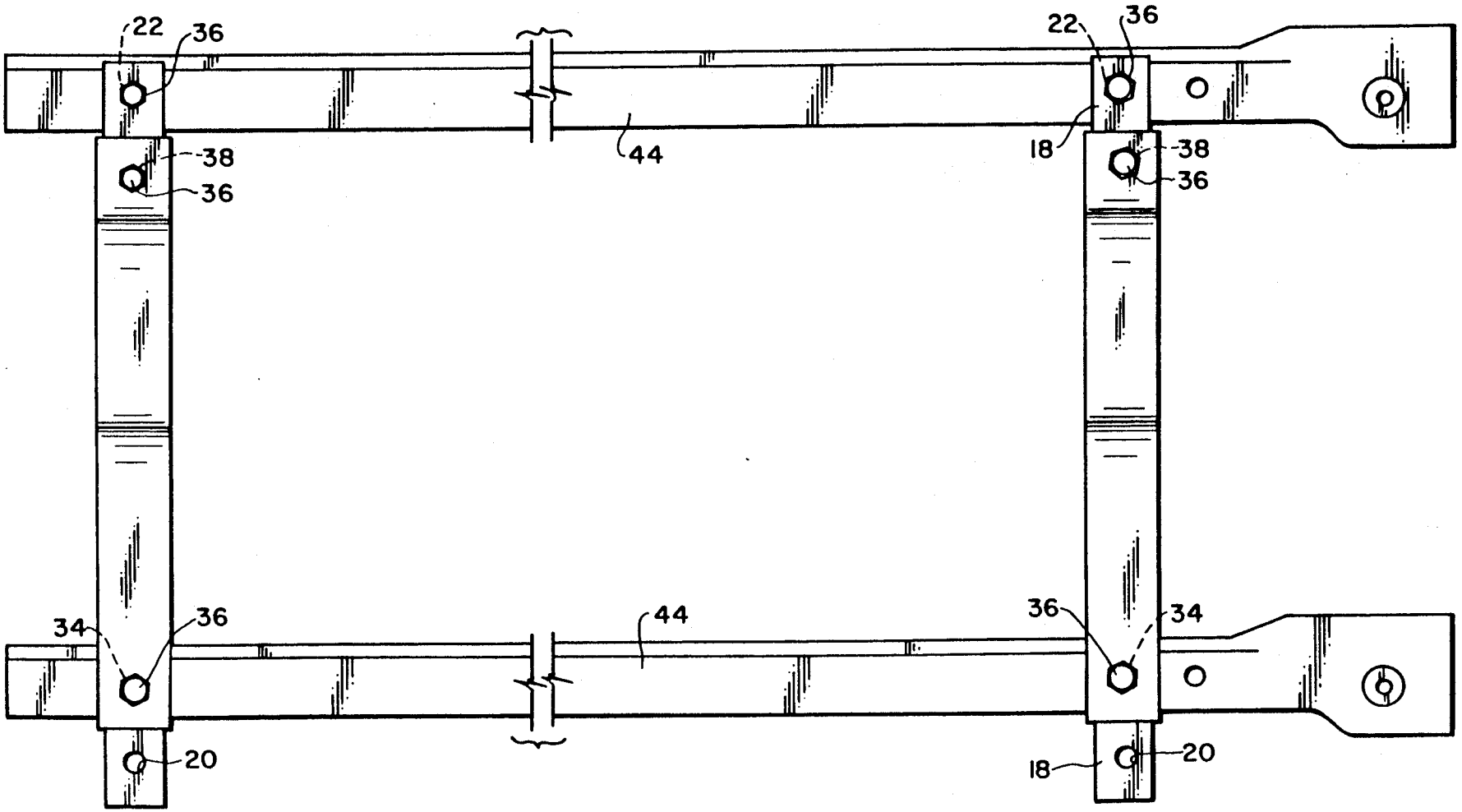
FIG. 2 is a side elevational view of the stacking basket organizer of FIG. 1 with the baskets omitted for clarity.

A stacking basket organizer 10 provided in accordance with the present invention and having two baskets 12 is shown by way of example in FIGS. 1 and 2. As will become more apparent below, one or more additional baskets could be mounted vertically above the basket assembly shown in FIGS. 1 and 2, in a manner analogous to the mounting of the upper basket with respect to the lower basket which is described in detail below.

Figure 5:
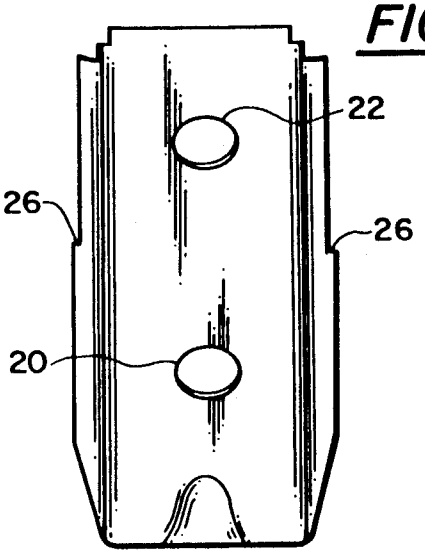
FIG. 5 is a side elevational view taken from the right of FIG. 3.

The stacking basket organizer of the invention includes a basic frame structure which is repeated for each tier. Thus, each tier includes first and second base frame members 14 of the type shown in FIGS. 3–5.

Figure 4:
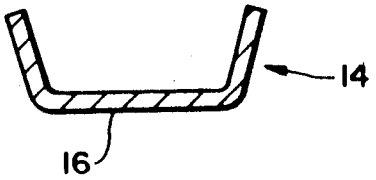
FIG. 4 is a cross-sectional view with parts omitted for clarity along line 4—4 of FIG. 3.
Figure 3:
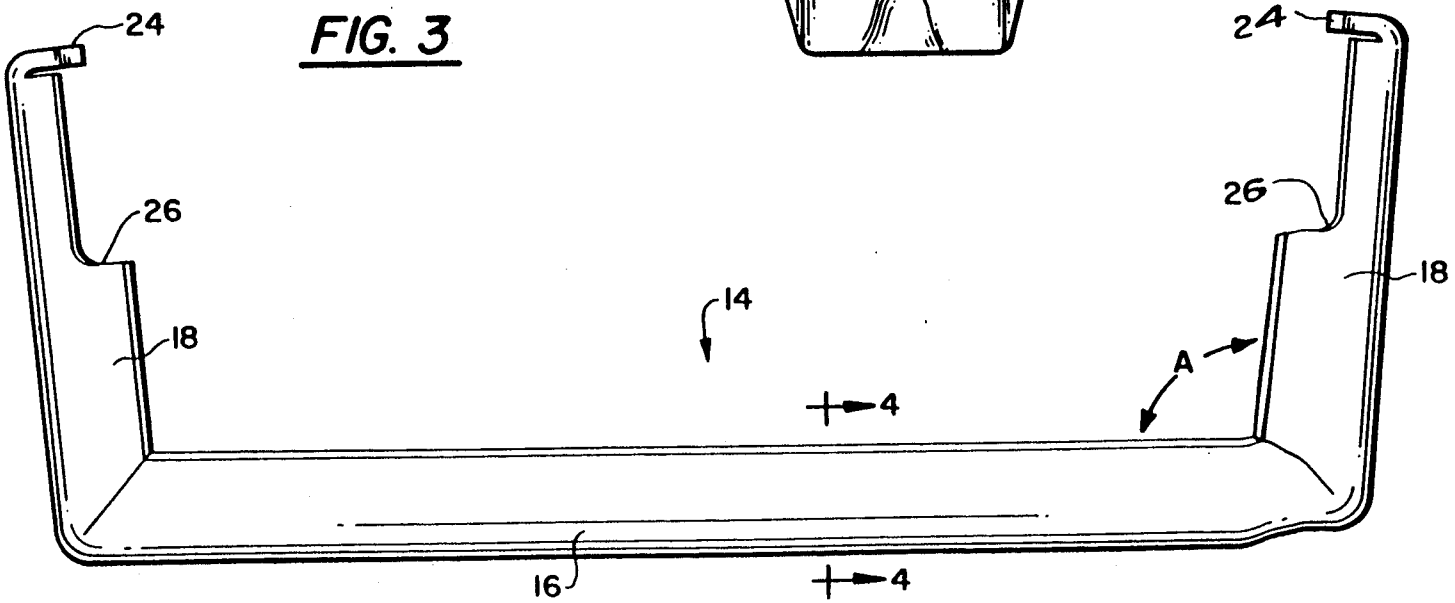
FIG. 3 is a front elevational view of a slide base frame provided in accordance with the present invention.

Each base frame member 14 may be made, for example, from a rolled metal plate which is stamped into a predetermined configuration and folded into the final U-shaped form shown in FIG. 3 including a transverse base portion 16 and first and second vertical portions 18. As noted below, the base frame members can be formed from plastic or aluminum rather than a rolled metal plate. The base frame member itself also has a substantially U-shaped cross-section as shown in FIG. 4. The vertically extending portions 18 are disposed at an angle A slightly greater than 90° relative to the transverse base portion 16. Thus, in the illustrated embodiment, the vertical portions 18 are disposed at an angle of about 95° relative to the transverse base portion 16. Apertures may (not shown) be defined through the transverse base portion so that the lowermost tier of the stacking basket assembly can be secured to a common surface, for example a shelf or the base of a cabinet. In the alternative, such apertures can accommodate fasteners for fixing an upper tier at a predetermining widthwise disposition with respect to a next lower tier, as discussed more fully below with reference to FIGS. 24–27. As yet a further alternative, such apertures can be left free from fastening structures.

The vertical portions 18 of the base frame member each have first and second apertures 20, 22 defined therethrough which enable the base frame member 14 to be used for the first tier, for an intermediate tier or for an uppermost tier of a stacking basket organizer, as will become more apparent below. The vertical portions also have a lip portion shown generally at 24 and cutout portions 26 which define support surfaces on each side of the base frame member for receiving right and left channel slides 44, 46, which are discussed more fully below.

The base frame members of vertically adjacent tiers are interconnected with uprights 28 of the type shown, for example, in FIGS. 12–15. Like the base frame member 14, the uprights 28 can be formed by stamping a flat sheet of metal to define an upright preform and then bending the resulting structure into the configuration shown in FIG. 12. Again, as noted below, the upright could be formed from plastic or aluminum as well. As can be seen, the uprights 28 are shaped so that when mounted between vertically adjacent base frame members 14, an outwardly bowed portion 30 is provided to accommodate the uppermost rim of a basket 12 which is ultimately mounted to the stacking basket organizer (FIG. 1). Furthermore, when the uprights are formed, a tongue element 32 is cut in the upright material and deformed at an angle B of slightly greater than 90° corresponding to angle A, for example 95°, relative to the plane of the uppermost end of the upright, as described more fully below.

The uprights 28 are attached to a vertically lower base frame member 14 by inserting a bolt, screw or the like 36 through a first aperture 34 of the upright, through the upper aperture 22 of the respective vertical portion 18 of the base member 14 and into a further aperture 50 defined in the respective channel slide 44, 46, as discussed more fully below. A nut or other similar conventional connector device (not shown) is then secured to the bolt or screw. The upright 28 is then fastened to the vertically upper tier by inserting a bolt, screw or the like 36 through the aperture 38 defined at the upper end of the uprights 28 and through a corresponding aperture 20 defined in the upper base frame member 14. The bolt or screw is then secured with a nut (not shown). The base frame member 14 of a vertically upwardly adjacent tier is thus seated between the vertical sidewalls 40 and against the endwall 42 of its respective upright 28 so that it sits on the inwardly extending tongue 32.

If yet a further stacking basket is to be mounted vertically above the upper of the baskets 12 shown in FIG. 1, further uprights 28 are coupled to the base frame members 14 of the second tier by inserting a bolt, screw or the like through the bottommost aperture 34 of each further upright 28, through the upper aperture 22 of the base frame member of the second tier and through the channel slides 44, 46 thereof. The channel slides of the uppermost tier, the second tier in FIG. 1, are fastened to their base frame members 14 by inserting a bolt, screw or the like 36 through the respective apertures 22, 50 of these two components and securing with a nut (not shown).

Figure 6:
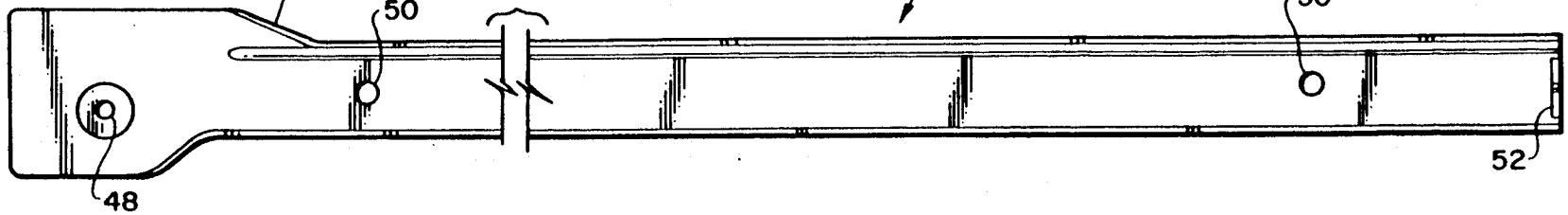
FIG. 6 is a side elevational view from the inside of a consolidated slide for the right side of a stacking basket organizer in accordance with the present invention.
Figure 7:
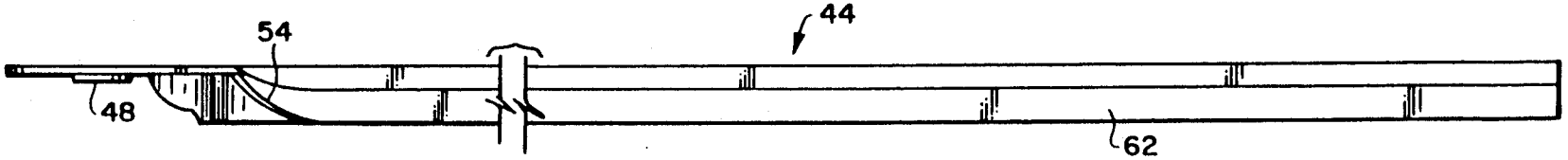
FIG. 7 is a view taken from above in FIG. 6.
Figure 8:
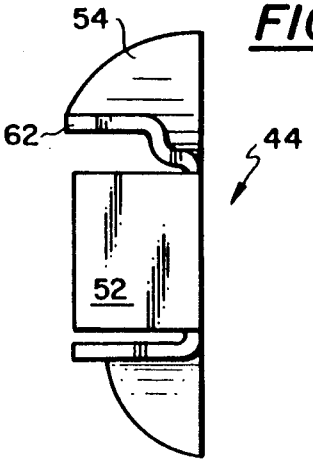
FIG. 8 is an end view taken from the right of FIG. 6.
Figure 9:
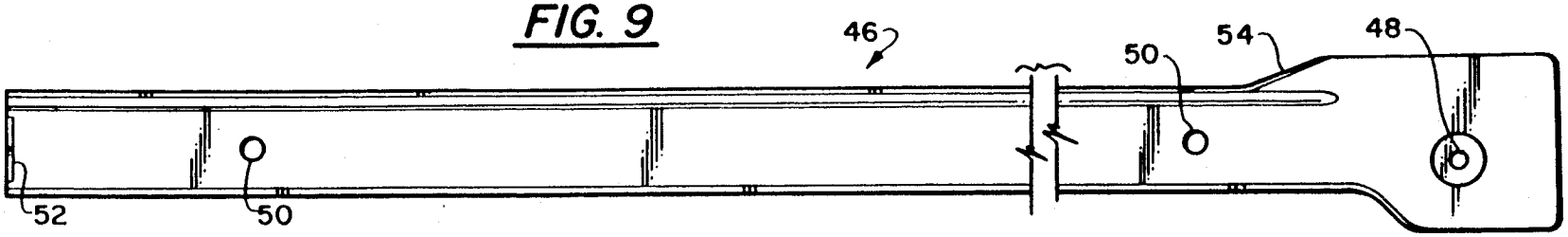
FIG. 9 is a side elevational view from the inside of a consolidated slide for the left side of a stacking basket in accordance with the present invention.
Figure 10:
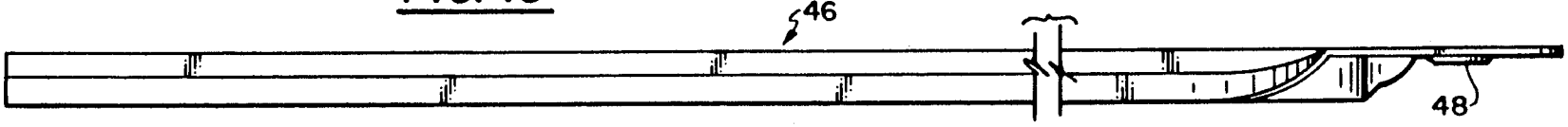
FIG. 10 is a view taken from above in FIG. 9.
Figure 11:
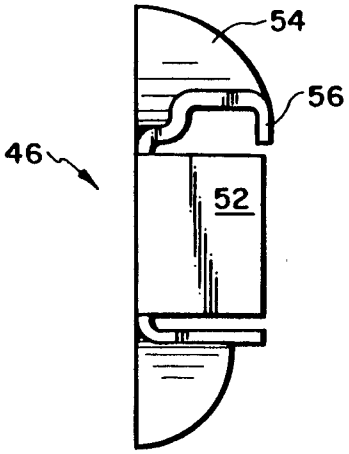
FIG. 11 is an end view taken from the left in FIG. 9.
Figure 12:
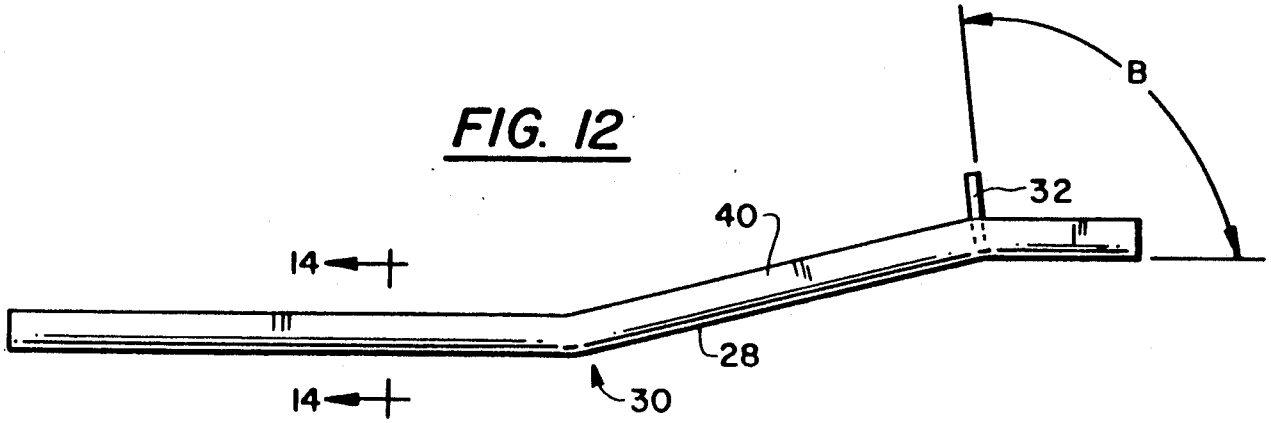
FIG. 12 is a side view of a frame upright provided in accordance with the present invention.
Figure 13:
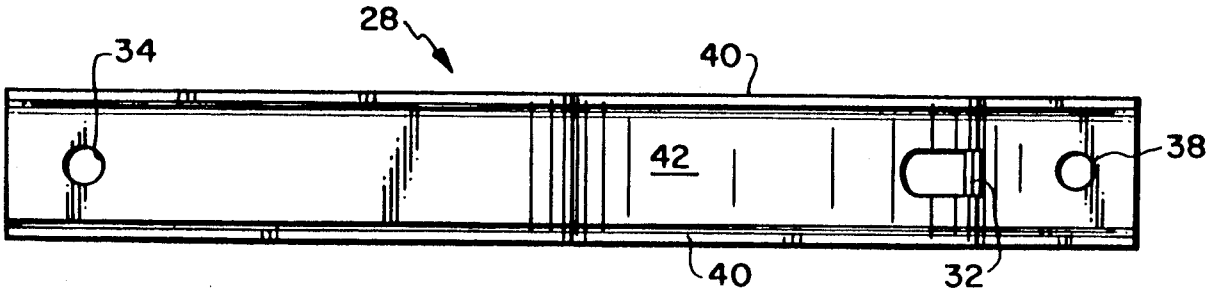
FIG. 13 is a view taken from above in FIG. 12.
Figure 14:
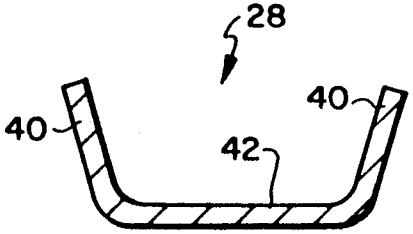
FIG. 14 is a cross-sectional view taken along 14—14 of FIG. 12.

Referring to FIGS. 6–11, right and left channel slides 44, 46 are provided in accordance with the present invention and are fixedly secured to and extend between the vertical portions 18 of the base frame members 14 of each tier. As shown in FIGS. 6–8, the right channel slide 44 of the invention can be formed from a flat plate which is stamped and then folded into the configuration shown. In the alterative, the slides can be cast, or, if plastic, molded. The front end of the right channel slide, on the left side of FIG. 6, includes an aperture 48 for mounting a wheel element (not shown in particular), for example a nylon wheel, for guiding the forward end of a basket rail as discussed more fully below. At least first and second apertures 50 are defined along the length of the right channel slide 44 for receiving the bolt, screw or the like 36 used to couple the upright 28 to the base frame member 14 and in turn to the channel slide 44 as discussed above. A stop plate member 52 is defined at the rear end of the right channel slide 44 for limiting rearward sliding motion of the basket rail, as will become more apparent below. Finally, a sloped surface 54 is defined adjacent the forward end of the right channel slide 44 to facilitate the mounting of the sliding basket 12 and its rail assembly to the channel slide 44 and frame assembly of the invention, as explained more fully below.

The left channel slide 46 of the invention is substantially similar to the right channel slide illustrated in FIGS. 6–8 and described above. Thus, the parts of the left channel slide 46 which correspond to parts of the right channel slide 44 are identified in FIGS. 9–11 using the same reference numerals and a description thereof is omitted here. Of notable distinction, however, is that the left channel slide includes a downwardly depending lip 56 which limits relative transverse motion of a sliding basket 12 and the frame assembly.

Figure 15:
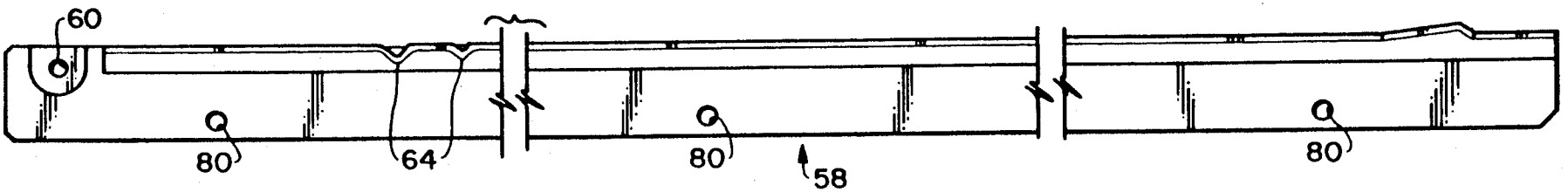
FIG. 15 is an elevational view from the inside of a consolidated rail for the right side of a stacking basket organizer provided in accordance with the invention.
Figure 16:
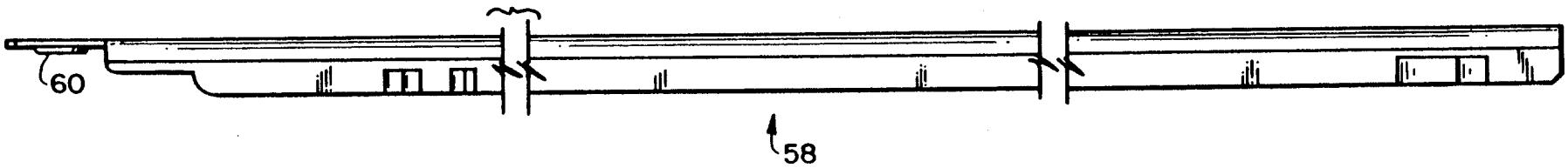
FIG. 16 is a view the from above in FIG. 15.
Figure 17:
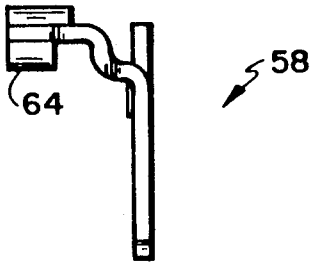
FIG. 17 is an end view taken from the right FIG. 15.

A right basket rail 58 provided in accordance with the present invention is shown in FIGS. 15–17. As can be seen, the rear end of the right basket rail, which is shown on the left of FIG. 15, includes an aperture 60 for receiving a wheel element (not shown), such as a nylon wheel. A wheel mounted to such a rail assembly will extend vertically above the uppermost edge of the rail and is thus adapted to roll along the horizontal lip 62 defined along the upper edge of the right channel slide 44 as shown, for example, in FIG. 1. Stops 64 are defined along the length of the rail so as to stop relative sliding motion of the basket assembly and the frame at a predetermined point or points by the engagement of the wheel of the slide 44 with stops 64. The basket can be slid further relative to the frame assembly if it is lifted slightly so that the stops are lifted over the wheel of the channel slide 44 in a known manner.

Figure 18:
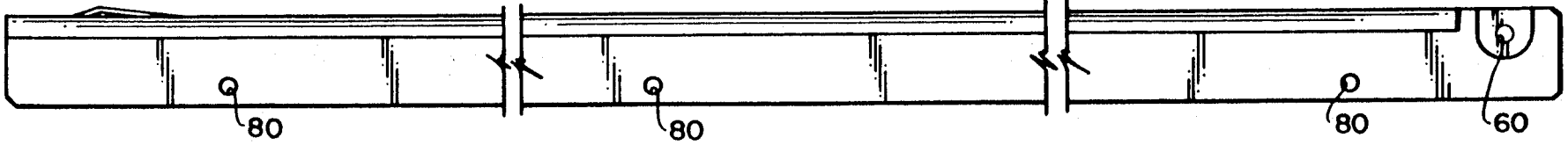
FIG. 18 is a view from the inside of a consolidated rail for the left side of a stacking basket organizer.
Figure 19:
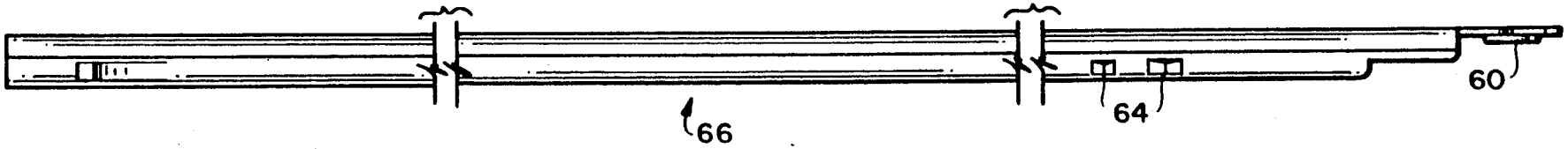
FIG. 19 is a view taken from above in FIG. 18.
Figure 20:
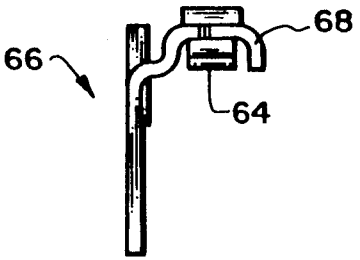
FIG. 20 is an end view taken from the left in FIG. 18.

The left rail 66 provided in accordance with the present invention is substantially similar to the right rail 58, discussed above with reference to FIGS. 15–17. Accordingly, like reference numerals identify corresponding parts in FIGS. 18–20 and a description thereof is omitted here. However, the left rail 66 further includes a downwardly depending lip 68 which limits relative transverse movement of the basket 12 and the frame assembly.

Thus, referring to FIG. 1, the wheel mounted to the left rail assembly 66 is adapted to roll along the channel slide 46 so that it rolls along the horizontal base thereof and rolls within the confines of the channel defined at the vertical upper portion of the left channel slide 46. The wheel mounted to the left channel slide 46, on the other hand, is engaged with the channel defined at the vertically upper portion of the left rail 66. The disposition of these wheels and the corresponding disposition of the wheels of the right rail 58 and right channel slide 44 prevent downward pivotal movement of the basket 12 relative to the frame but allows the forward end of the basket to be lifted vertically upwardly a certain amount relative to the wheels of the channel slides to enable withdrawal of the basket 12 beyond the point defined by the stops 64 and, hence, removal of the basket from the system.

Figure 23:
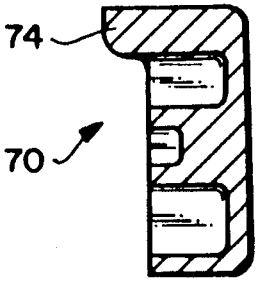
FIG. 23 is a sectional view along line 23—23 of FIG. 22.
Figure 21:
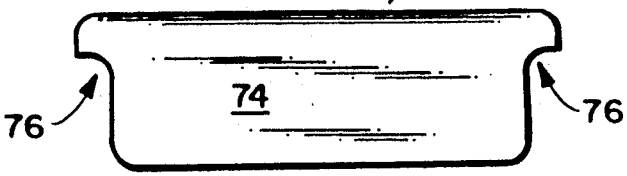
FIG. 21 is a top plan view of a basket rail clip provided in accordance with the invention.
Figure 22:
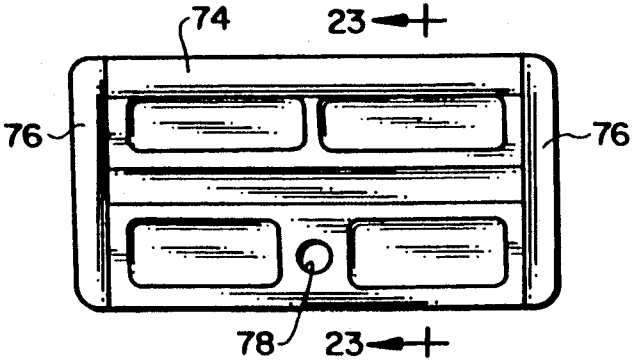
FIG. 22 is a front elevational view of a basket rail clip provided in accordance with the invention.

Referring to FIGS. 21–23, the right and left rails 58, 66 are mounted to the baskets in accordance with the present invention with a basket rail clip 70. The basket rail clip 70 is inserted between adjacent vertical rods 72 of a respective sideframe of the basket so that the top plate 74 of the basket rail clip 70 is disposed between adjacent vertical rods 72 and such vertical rods 72 are each respectively engaged in a recess of the clip 70. In the alternative, the rails may be welded to the respective baskets. The respective rail member 58, 66 is coupled to the clip 70 by inserting a bolt, screw or the like 36 through an aperture 78 in the respective rail clip, and through a corresponding aperture 80 defined in the right or left basket rail 58, 66 and securing with a nut (not shown). Tightening the nut clamps the rail clip and the rail together, with the sidewall of the basket disposed therebetween. The clip 70 can be made from any suitable material such as plastic, wood or metal.

Figure 24:
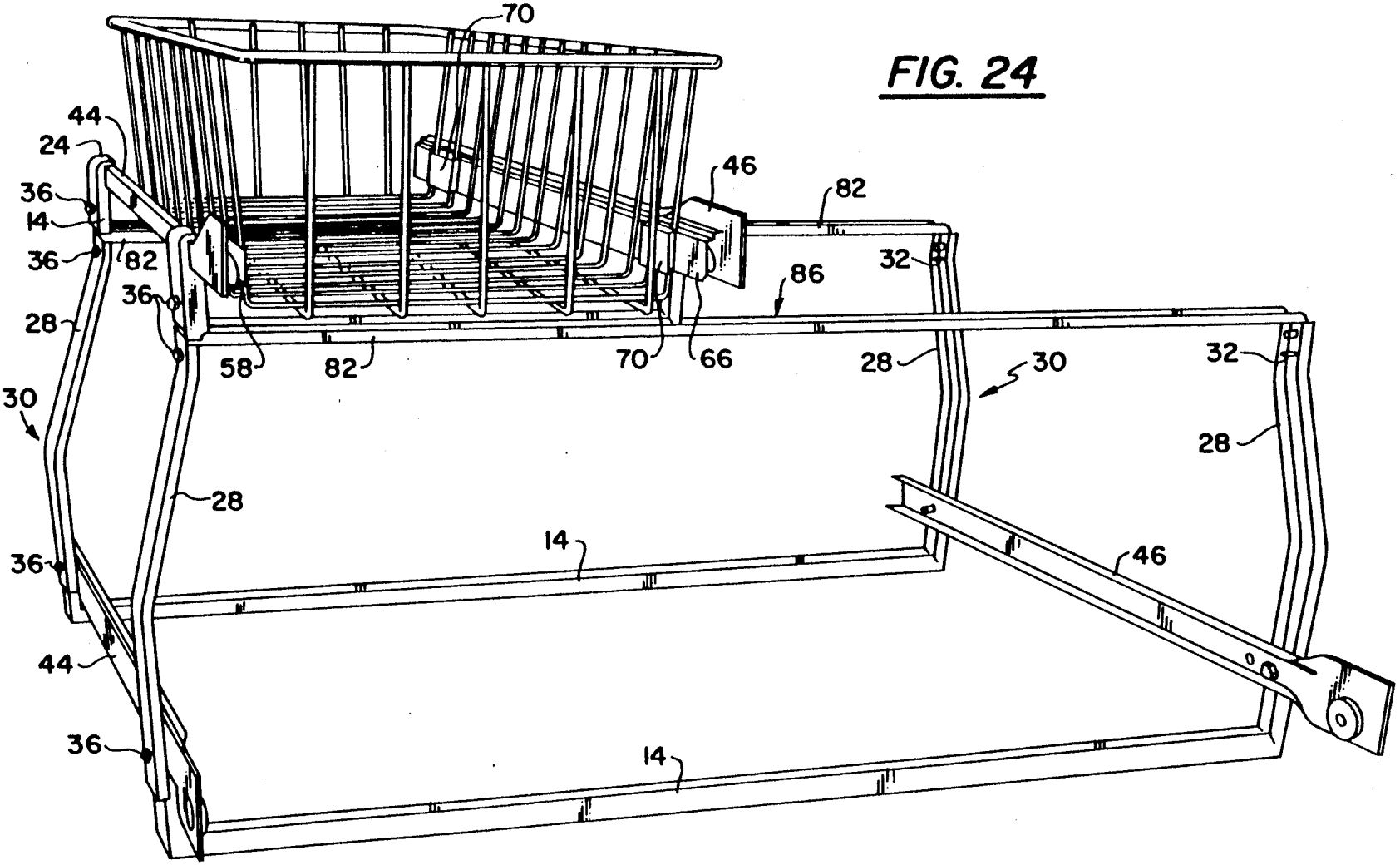
FIG. 24 is a perspective view showing a frame provided in accordance with the present invention for mounting a smaller width basket atop a large width basket, showing the smaller basket but omitting the larger basket for clarity.
Figure 25:
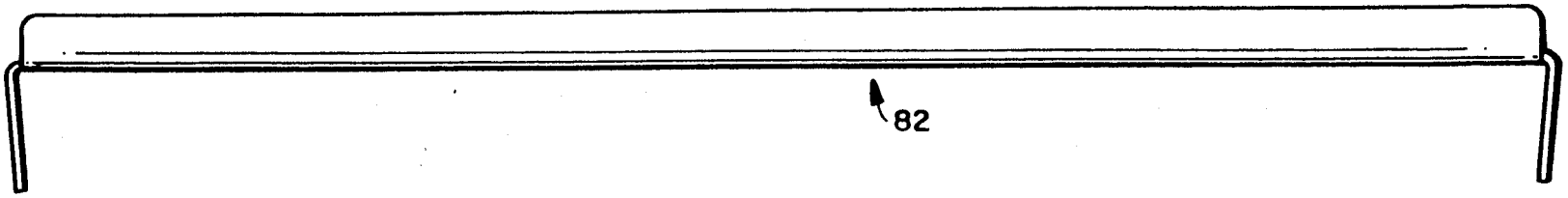
FIG. 25 is a side elevational view of a stacking mounting bracket.
Figure 26:
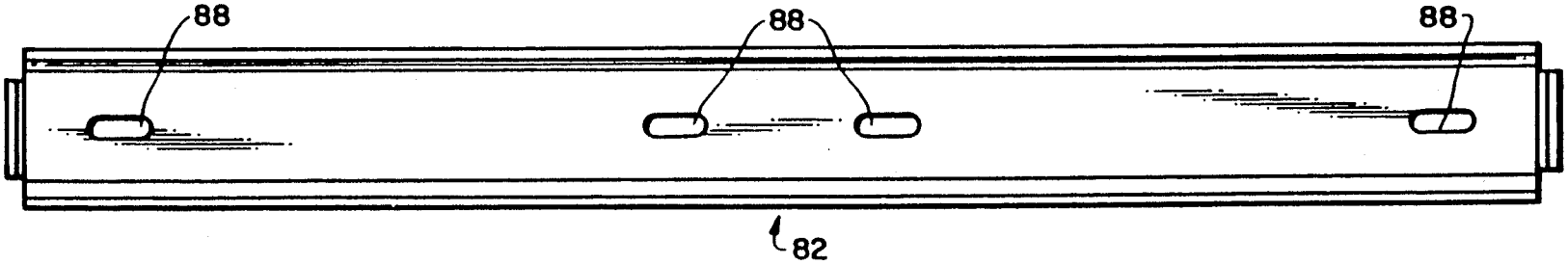
FIG. 26 is a top plan view of a stacking mounting bracket.
Figure 27:
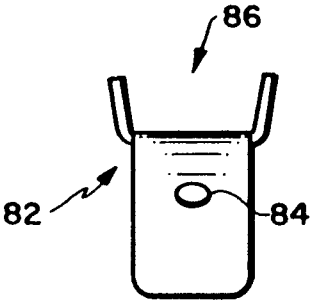
FIG. 27 is an end view of a stacking mounting bracket.

An alternate embodiment of the present invention is shown in particular in FIG. 24. In this embodiment, the base frame members 14 and uprights 28 utilized to define tiers and to interconnect tiers are identical to those in the embodiment discussed above with reference, in particular to FIG. 1. However, a stacking mounting bracket 82 is further provided which enables a basket of smaller transverse or widthwise dimensions to be mounted vertically above a large basket. Thus, base frame members 14 of suitable size for the basket of the first tier are coupled to respective channel slides 44, 46 and uprights 28 to define a first tier frame. A stacking mounting bracket 82 of the type shown in particular in FIGS. 25–27 is then secured to the first tier frame by inserting a bolt, screw or the like 36 through the uppermost aperture 38 of the uprights 28 of each of a respective pair of uprights and through aligned apertures 84 of the stacking mounting bracket 82 disposed therebetween. Because the stacking mounting bracket 82 defines an upwardly open channel 86, the base frame members 14 which define the base of the vertically upper tier can be transversely slidably disposed above the first tier frame.

If desired, the upper tier can be left freely transversely slidable relative to the larger base frame. In the alternative, a bolt, screw or the like 36 can be inserted through apertures (not shown) defined in the base frame member 14 of the second tier and through suitably disposed apertures 88 defined in the stacking mounting bracket 82. Thus, the upper basket frame can be fixed with respect to the frame of the lower basket at a predetermined transverse location. If desired, apertures can be provided so that the upper frame can be selectively fixed in at least two different transverse positions.

While the invention has been described in connection with channel slides, rails, base frame members and uprights which are formed from stamped plate metal which is, for example, coated with paint or a plastic material, it is to be understood that the slides, rails, frames and uprights of the invention could be formed from any suitable material including uncoated metal, plastic and/or wood. Likewise, while a particular configuration has been illustrated for the right and left channel slides and for the right and left basket rails, it is to be appreciated that the particular configuration of the channel slides and rails could be altered without modifying the most basic concept of this invention and thus such modifications are deemed to be within the scope of this invention. Even further, while base frame members and channel slides have been disclosed for forming the frame and uprights have been disclosed for interconnecting tiers or frames, it is to be understood that the single or multi-tier frame could be formed from more or fewer components or components having differing configurations from those shown without departing from the invention which is defined in its broadest respects and is limited only by the appended claims.

What is claimed is:

1. An assembly comprising:

a first base frame, said first base frame including first and second base frame members, each said base frame member having a longitudinal axis, and means for interconnecting longitudinal ends of said base frame members so that said base frame members are disposed in parallel spaced apart relation;

a second base frame, said second base frame including first and second base frame members, each said base frame member having a longitudinal axis, and means for interconnecting longitudinal ends of said base frame members so that said base frame members are disposed in parallel spaced apart relation;

means for mounting said second base frame vertically above and spaced from said first base frame, said means for mounting including a plurality of upright elements, each said upright element having a longitudinal axis and first and second ends, said upright elements being mounted to said first base frame at said first end thereof so as to extend vertically upwardly from said first base frame, and means for mounting said second base frame to said second end of said upright elements;

a first storage element slidably mounted to said means for interconnecting longitudinal ends of said base frame members of said first base frame; and a second storage element slidably mounted to said means for interconnecting longitudinal ends of said base frame members of said second base frame, said means for mounting said second base frame to said upright elements includes at least first and second storage element mounting brackets coupled to and extending between first and second opposed pairs of upright elements so that said storage element mounting brackets are disposed in parallel, spaced relation and are spaced apart a distance corresponding to a spacing of said base frame members of said second base frame, said base frame members of said second base frame being slidably mounted to said storage element mounting brackets so as to be slidable along longitudinal axes thereof and transversely with respect to a longitudinal axis of said second storage element.

2. A basket assembly as in claim 1, further comprising means for fixedly attaching said second base frame to said storage element mounting brackets at a predetermined transverse location thereon.

3. An assembly as in claim 1, wherein said first and second storage elements comprise first and second basket elements.

4. An assembly as in claim 1, further comprising at least first and second apertures defined in each base frame member of said first base frame for receiving a bolt for securing each said base frame member to a base of a cabinet in which said assembly is disposed.

* * * * *